US005884520A

United States Patent [19]

Bakermans

[11] Patent Number: 5,884,520

[45] Date of Patent: Mar. 23, 1999

[54] DIE SET HAVING SHUT HEIGHT ADJUST AND STRIPPER PLATE ACTUATOR MECHANISMS

[75] Inventor: Johannes Cornelis Wilhelmus Bakermans, Harrisburg, Pa.

[73] Assignee: The Whitaker Corporation, Wilmington, Del.

[21] Appl. No.: 971,948

[22] Filed: Nov. 17, 1997

[51] Int. Cl.[6] ..... B21J 13/00

[52] U.S. Cl. ..... 72/407; 72/446; 72/427; 100/257

[58] Field of Search ..... 72/404, 407, 446, 72/344, 427; 100/257; 83/527, 530

[56] References Cited

U.S. PATENT DOCUMENTS

| | | | |
|---|---|---|---|
| 3,030,878 | 4/1962 | Holzer | 72/446 |
| 4,676,090 | 6/1987 | Nishimura | 72/446 |
| 4,790,173 | 12/1988 | Boutcher | 72/446 |
| 4,791,803 | 12/1988 | Broquet | 72/446 |
| 5,031,439 | 7/1991 | Riedisser | 72/427 |
| 5,410,928 | 5/1995 | Bakermans et al. | 83/155 |

FOREIGN PATENT DOCUMENTS

| | | | |
|---|---|---|---|
| 350156 | 6/1931 | United Kingdom | 72/446 |
| 657192 | 9/1951 | United Kingdom | 72/427 |

*Primary Examiner*—Daniel C. Crane

*Attorney, Agent, or Firm*—Bradley N. Ditty; Mary K. Van Atten

[57] ABSTRACT

A die set (24) for use with a stamping and forming machine (10) includes two opposed tooling plates (50, 52) arranged to undergo reciprocating motion with respect to a base plate (40) toward and away from a strip of material (30) that is fed along a feed path (38) between the two ram plates (50, 52). Each ram plate has a tooling attachment plate (58, 60) having tool mounting surfaces (62, 64) facing inwardly toward the feed path (38) for the attachment of punch and die tooling assemblies (26, 28) for performing the stamping and forming operations on the strip of material. Each of the ram plates (50, 52) includes a shut height adjusting mechanism (100) associated with each tooling attachment plate (58, 60) for adjusting the shut height of individual tooling. Additionally, each of the ram plates (50, 52) includes a stripper plate actuating mechanism (140) associated with each tooling attachment plate (58, 60) for actuating the stripper plates (162) of each individual tooling unit (86) as well as adjusting the spring force on each stripper plate (162).

18 Claims, 7 Drawing Sheets

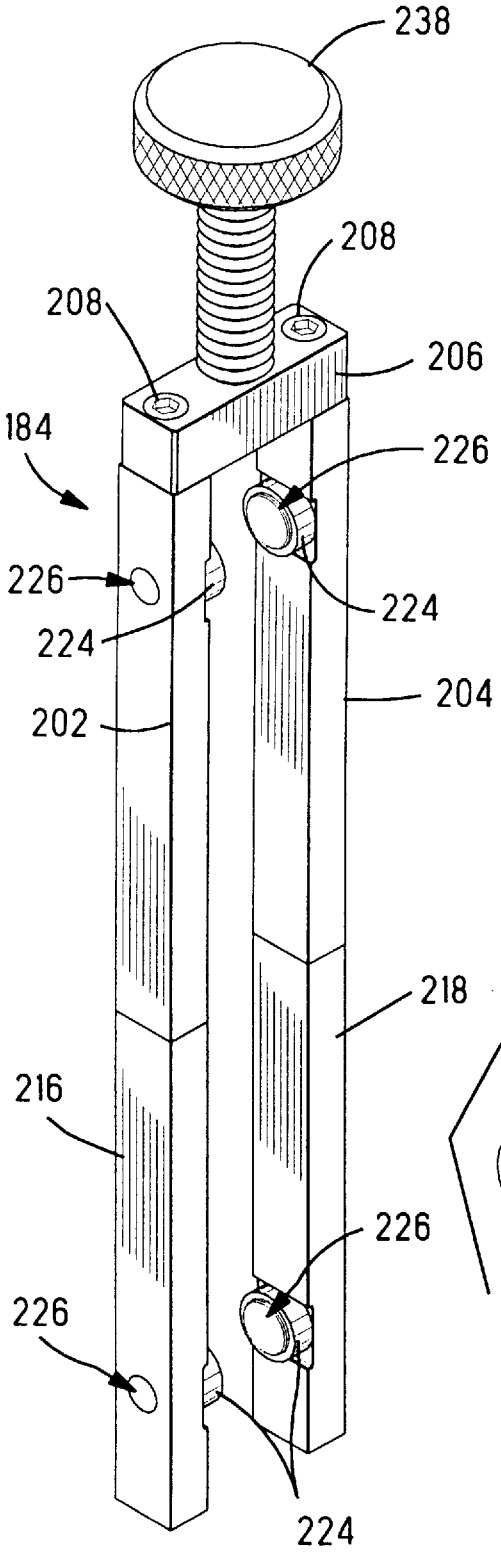
Fig. 8
Fig. 10
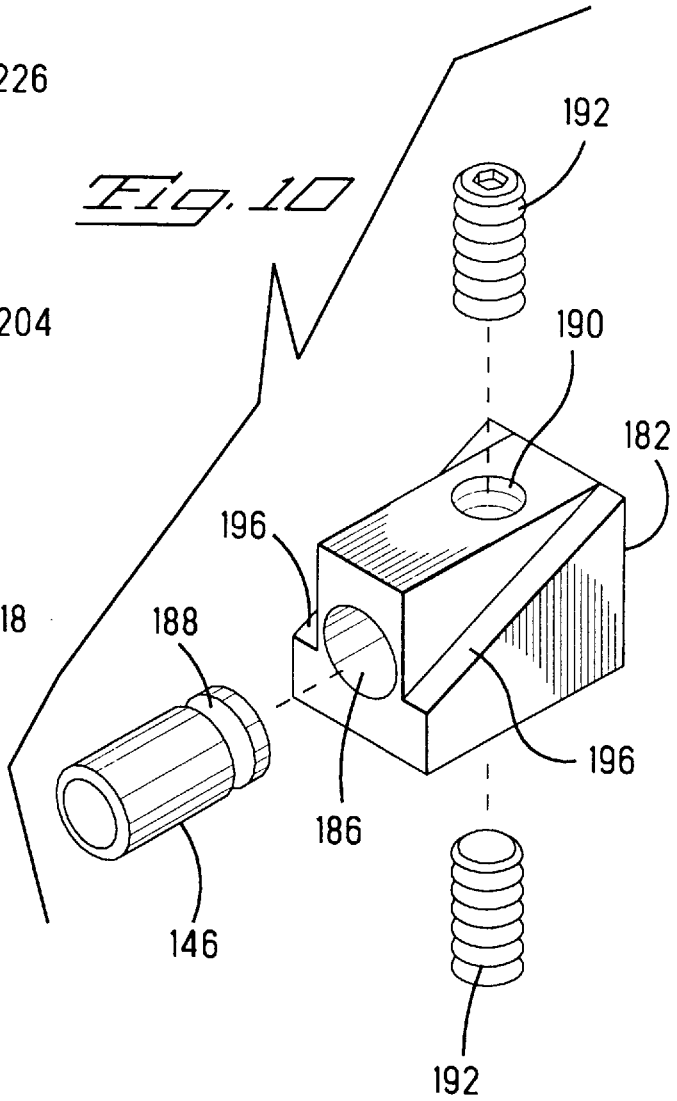

DIE SET HAVING SHUT HEIGHT ADJUST AND STRIPPER PLATE ACTUATOR MECHANISMS

The present invention relates to a multiple station die set having mutually facing mounting surfaces for receiving multiple mating punch and die assemblies for use in a stamping and forming machine, and more particularly to such a die set having mechanisms in each station for adjusting the shut height of the tooling, actuating a stripper plate in the tooling, and for providing the desired spring force to the stripper plate.

BACKGROUND OF THE INVENTION

Punch and die assemblies used in conventional stamping and forming machines are typically attached to opposed mounting surfaces of a die set, and arranged so that a strip of material can be fed along a feed path while the punches and dies are moved into and out of engagement to perform various stamping and forming operations on the strip. Such punch and die assemblies often have multiple stations, each of which will perform a different operation on the strip as the strip is momentarily stopped in position at the station. Each station has its own punch and mating die, or in certain cases forming tooling, and requires appropriate mechanisms for adjusting the shut height, such as shims or screw or cam mechanisms, and other mechanisms for actuating the stripper plate. Therefore, in the case of a die set having a five station punch and die assembly, five separate shut height adjusting mechanisms are needed as well as five separate stripper plate actuating mechanisms and their associated springs. This contributes greatly to the complexity and the cost of producing the punch and die assemblies and to the cost of their maintenance.

In universal stamping and forming machines, those having two mutually opposed ram levers, such as the machine disclosed in U.S. Pat. No. 5,410,928 which issued May 2, 1995 to Bakermans, et al. and which is incorporated herein by reference, the mating punch and die assembly is in the form of a box structure. That is, an outer guide structure having four walls, in the shape of a box with two opposite open ends, contains the punch assembly in one end and the die assembly in the other end. The four walls then guide the punch and die assemblies during their reciprocating motion toward and away from each other. In this case, as with the conventional die set, a die set having a five station punch and die assembly, requires five separate shut height adjusting mechanisms as well as five separate stripper plate actuating mechanisms.

What is needed is a die set having mechanisms built in that can be interfaced with individual punch and mating die units so that the built in mechanisms can adjust shut height and can operate the stripper plates of the units in each station, thereby obviating the need for providing such mechanisms in each and every punch and mating die unit.

SUMMARY OF THE INVENTION

A stamping and forming machine is provided having a drive ram arranged to undergo reciprocating motion and a die set for holding and guiding punch and die tooling assemblies. The die set includes a first ram plate having coupled thereto at least one first tool plate with a first mounting surface for receiving and carrying first stamping and forming tooling. Means is provided for holding second stamping and forming tooling, matable with the first stamping and forming tooling. The first and second stamping and forming tooling have a feed path therebetween for passage of a strip of material to be operated upon by the tooling. A drive coupling is arranged to couple the drive ram to the first ram plate so that the drive ram imparts the reciprocating movement thereto. The die set includes an actuating mechanism attached to and carried by the first ram plate which is arranged for adjusting the shut height of the first stamping and forming tooling or actuating a stripper plate thereof.

DESCRIPTION OF THE FIGURES

FIG. 8 is an isometric view of some of the components of the stripper plate spring pressure release mechanism;

FIG. 10 is an exploded parts view of the cam assembly that is part of the stripper plate spring pressure release mechanism.

DESCRIPTION OF THE PREFERRED EMBODIMENT

Figure 1:
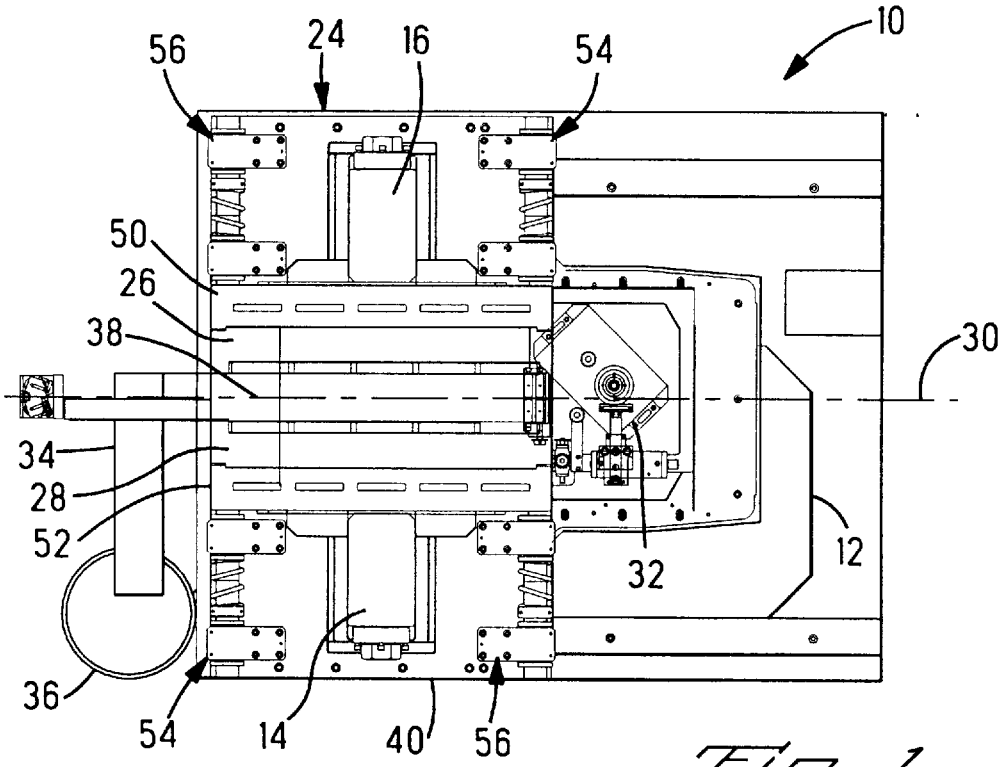
FIGS. 1 and 2 are plan, and side views of a stamping and forming machine incorporating the teachings of the present invention.
Figure 2:
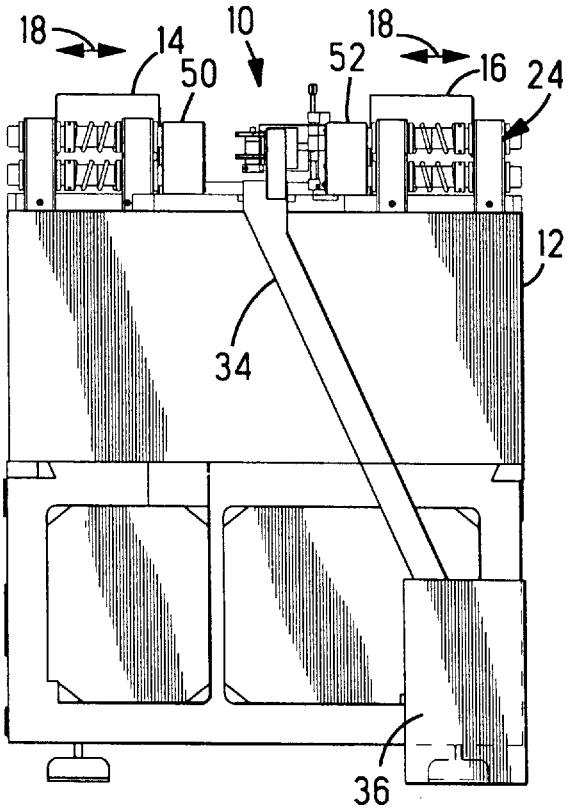

There is shown in FIGS. 1 and 2, a stamping and forming machine 10 having a frame 12, and first and second opposed pivoting levers 14 and 16 which undergo pivoting motion so that their ends alternately move toward and away from each other in the directions of the arrows 18, as shown in FIG. 2. This type of stamping and forming machine is described more fully in the above referenced '928 patent and, therefore, need not be fully described here. The machine 10 includes a die set 24 for holding and operating mating punch and die assemblies, 26 and 28 respectively, for performing stamping and forming operations on a strip 30 of material in the manufacture of electrical contacts and other stamped and formed parts. A feed unit 32, attached to the frame 12, feeds the strip 30 into the area between the punch and die assemblies along a feed path 38 intermittently in timed relation to the operation of the machine. A scrap collection system 34 is arranged to collect bits and pieces of material left over from the stamping and forming operations and direct this material to a scrap barrel 36, in the usual manner.

Figure 3:
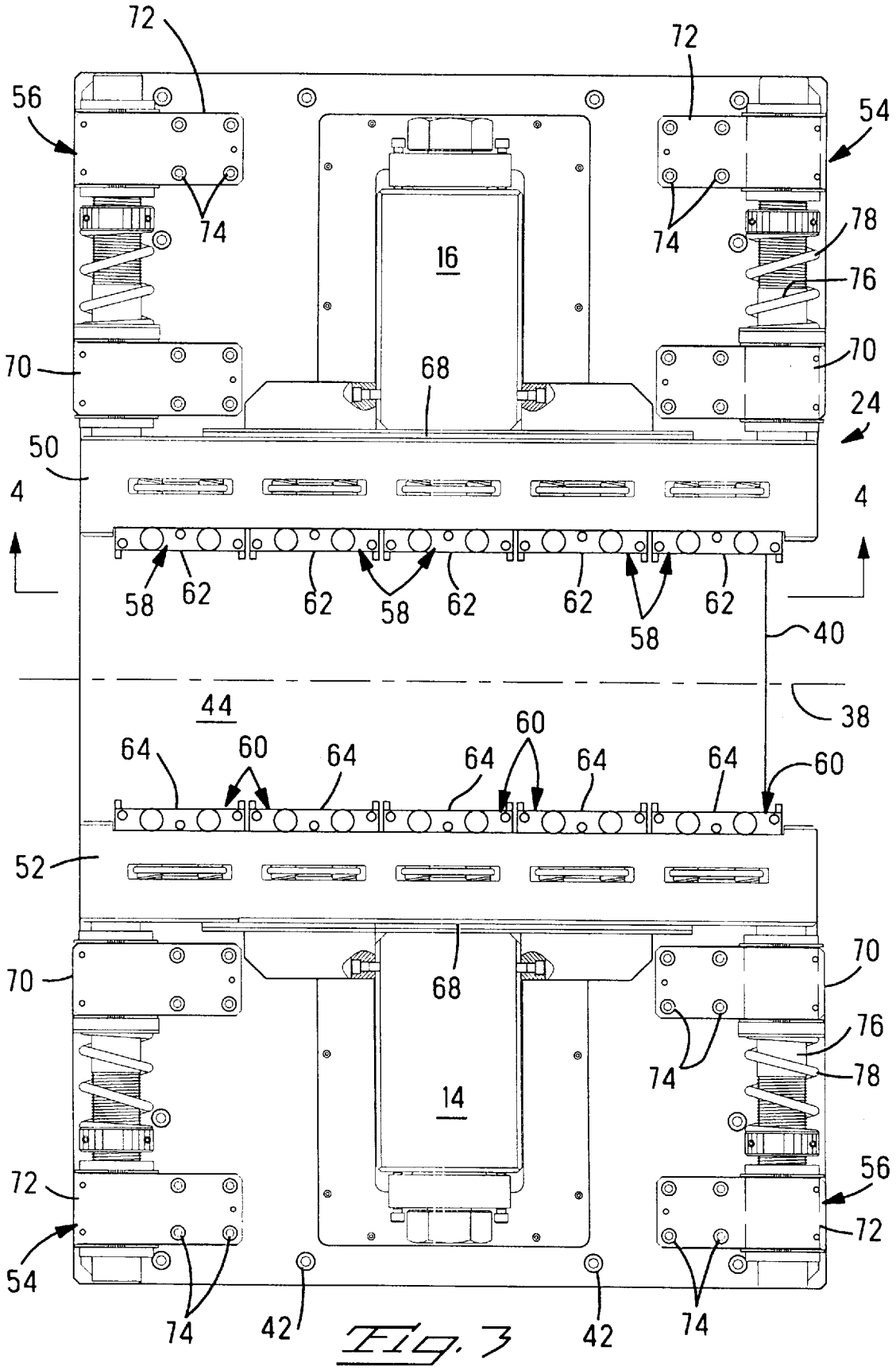
FIG. 3 is an enlarged plan view of the die set shown in FIG. 1.
Figure 4:
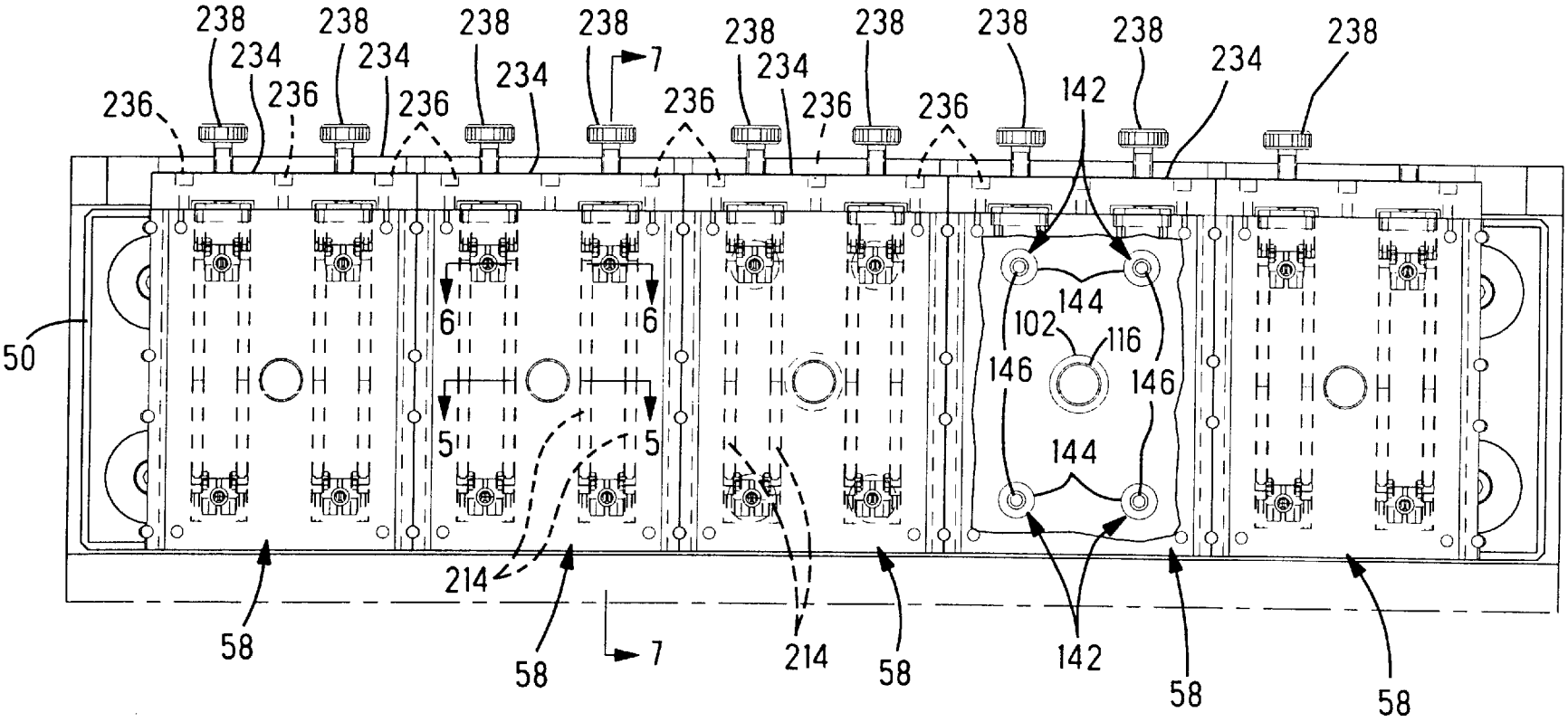
FIG. 4 is a cross-sectional view taken along the lines 4—4 in FIG. 3.

As shown in FIG. 3, the die set 24 includes a base plate 40 secured to the frame 12 by means of screws 42 that extend into threaded holes in the frame. The base plate 40 includes an upwardly facing major mounting surface 44. First and second ram plates 50 and 52 are disposed on opposite sides of the feed path 38, as best seen in FIG. 4, and are coupled to the major mounting surface 44 by means of first and second couplings 54 and 56 which are similar but are mirror images of each other. Five tooling attachment plates 58 are coupled to the first ram plate 50 and five similar tooling attachment plates 60 are coupled to the second ram plate 52, as shown in FIGS. 3 and 4. The tooling plates 58 and 60 have tool mounting surfaces 62 and 64, respectively, that are mutually opposed and face inwardly toward the feed path 38. The tool mounting surfaces are arrange to receive and hold stamping and forming tooling. The first and second couplings 54 and 56 allow the ram plates to undergo reciprocating movement in a forward direction toward the feed path 38 and in a reverse direction parallel to the major mounting surface. The ram plates 50 and 52 are completely guided in their movement and supported by their respective first and second couplings 54 and 56. A drive coupling 68 couples each of the levers 14 and 16 to its respective tooling plate 52 and 50. The drive couplings are arranged to accommodate the pivoting motion of the levers 14 and 16 while imparting linear movement to the ram plates 52 and 50. Each of the first and second couplings 54 and 56, as shown in FIG. 3, includes inner and outer spaced apart support blocks 70 and 72 attached to the major mounting surface 40 by means of screws 74 that extend through holes in the support blocks and into threaded holes in the base plate 40. Each of the support blocks 70 and 72 have two vertically arranged linear ball bearings which slidingly support posts 76 that are rigidly attach to and extend from their respective ram plates 50 and 52. Return springs 78 are positioned to urge the ram plates 50 and 52 in a direction away from the feed path 38 to their retracted positions as the first and second levers 14 and 16 pivot away from the feed path.

The first and second ram plates 50 and 52 and their associated tooling attachment plates 58 and 60 are substantially similar. Therefore, the structures of only the ram plate 50 and the tooling plates 58 will be described, and it will be understood that the ram plate 52 and tooling plates 60 are similarly structured. The tooling attachment plates 58 and 60 are arranged to receive either punch or die tooling 86, indicated in phantom lines in FIG. 5. The tooling 86 is held in place and attached to the plates by means of keys 88 that engage slots in both the tooling and the plates.

Figure 5:
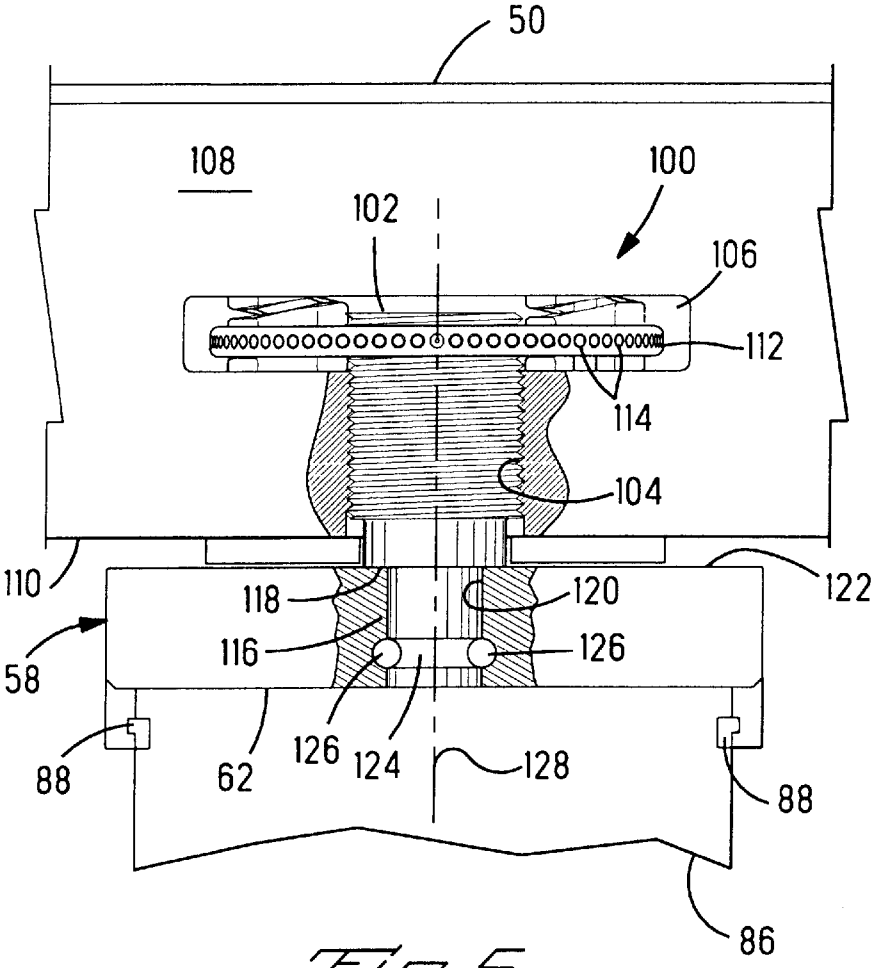
FIG. 5 is a cross-sectional view taken along the lines 5—5 in FIG. 4.

As shown in FIGS. 3, 4, and 5, a shut height adjustment mechanism 100 is attached to and carried by the ram plate 50. The mechanism 100 includes a threaded member 102 in threaded engagement with a threaded bore 104 formed in the first ram plate 50. The threaded bore 104 extends from a cutout 106 or pocket formed in the ram plate intersecting an upper surface 108 thereof to a forward surface 110 that is square with the major mounting surface 44. An adjusting disc 112 is rigidly attached to the end of the threaded member 102 so that the adjusting disc is disposed within the cutout 106, as shown in FIG. 5. A series of holes 114 are formed in the periphery of the disc for insertion of a pointed tool to aid in turning the disc when adjusting the shut height. A reduced diameter 116 having a shoulder 118 is formed on the end of the threaded member opposite the disc 112. The reduced diameter is a slip fit with a hole 120 formed in the tooling attachment plate 58 and the shoulder 118 is in abutting engagement with the surface 122 of the plate 58. An annular groove 124 is formed in the end of the reduced diameter for receiving a pair of pins 126 that extend downwardly through holes formed in the tooling attachment plate 58. This effectively renders the tooling attachment plate captive to the first ram plate 50. The axis 128 of the threaded member 102 is square with the tool mounting surface 62. By rotating the adjusting disc 112, the tooling attachment plate 58 is made to move away from or toward the feed path 38 while the first ram plate 50 remains stationary, thereby changing the shut height of the tooling 86. Since the cutout 106 intersects the upper surface 108, the adjusting disc 112 is accessible from above the machine 10, as viewed in FIG. 2.

Figure 6:
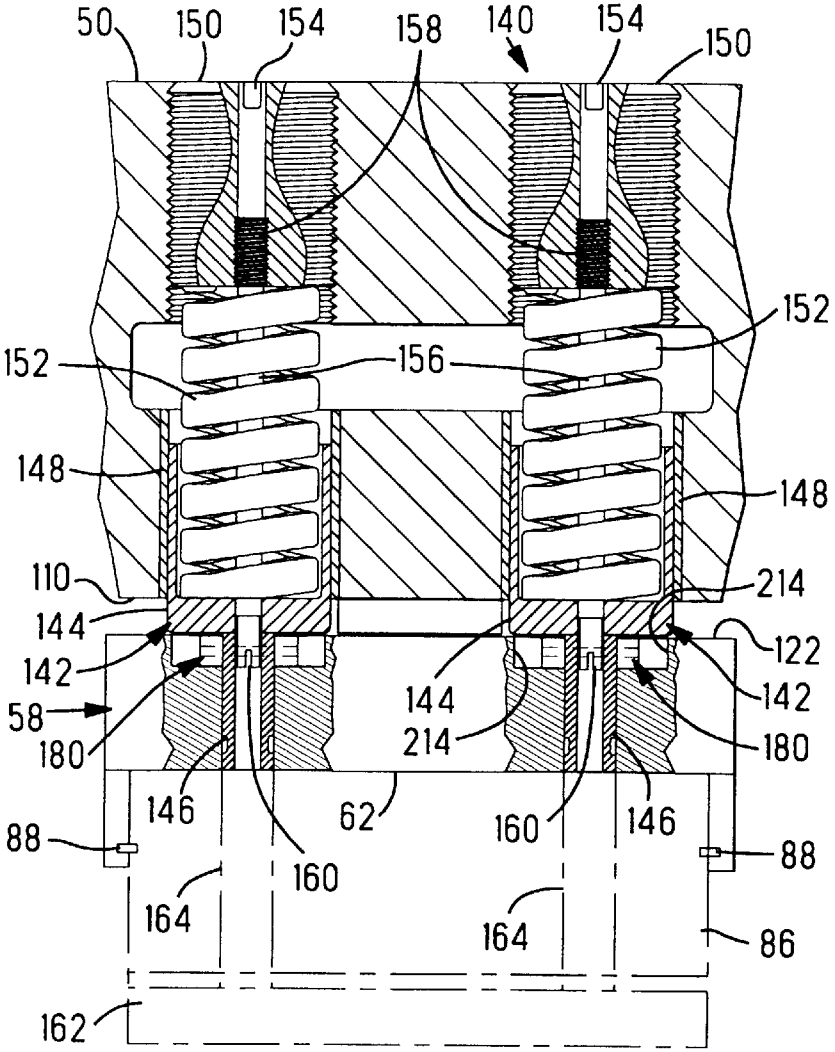
FIG. 6 is a cross-sectional view taken along the lines 6—6 in FIG. 4.
Figure 7:
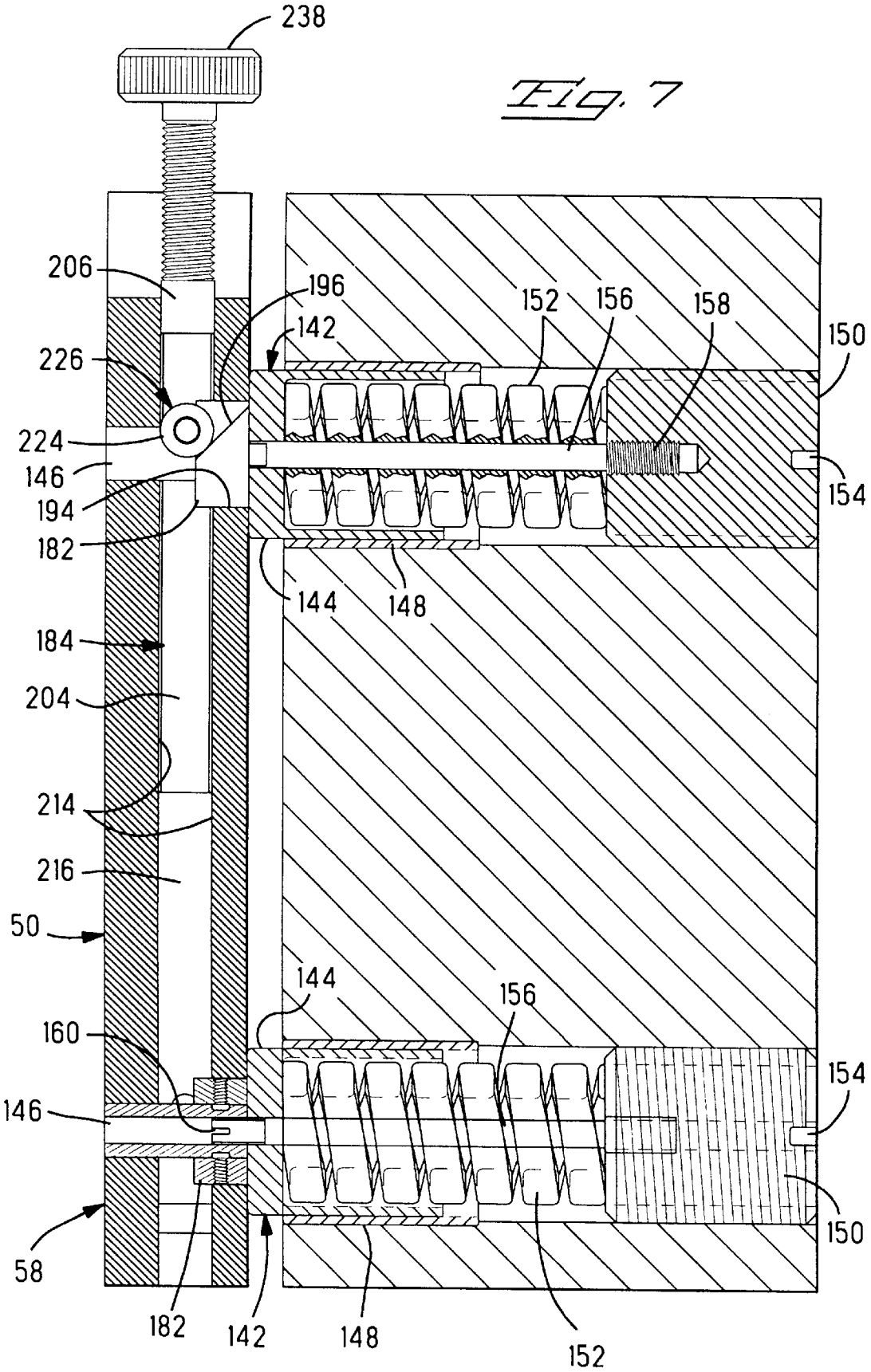
FIG. 7 is a cross-sectional view taken along the lines 7—7 in FIG. 4.

As best seen in FIGS. 4, 6, and 7, a stripper plate actuating mechanism 140 is attached to and carried by the first ram plate 50. The mechanism 140 includes four presser members 142, each of which includes a cup-shaped member 144 and a coupling end 146. As best seen in FIG. 4, the four presser members 142 are symmetrically spaced about the reduced diameter 116 in a rectangular pattern. Each cup-shaped member 144 is in sliding engagement with a sleeve 148 that is pressed in a bore in the first ram plate 50, as best seen in FIG. 6. The coupling ends 146 are in sliding engagement with holes formed through the tooling attachment plate 58 and are coaxial with and abut against corresponding cup-shaped members 144. The bores containing the sleeves 148 extend completely through the first ram plate 50 and are threaded at their ends opposite the sleeves 148. A threaded member 150 is in threaded engagement with the threaded portion of each bore, and abuts an end of a compression spring 152 that extends from the threaded member 150 to the inside bottom of the corresponding cup-shaped member 144, as shown in FIG. 6. The spring 152 provides an axially directed force to the coupling end 146 for a purpose that will be described below. The threaded members 150 include a screwdriver slot 154 in their outboard ends for easy rotation to adjust the force of the spring that is applied to the coupling end 146. Once the first ram plate 50 is mounted in the machine 10, some of the threaded members 150 will not be accessible for adjusting. To provide access from the tooling side of the ram plate 50, an extension rod 156 having a threaded end 158 is tightly threaded into a hole in each threaded member 150. The other end of the rod extends through a hole formed through the bottom of the cup-shaped member 144 and through a hole in the coupling end 146. The end of the rod includes a screwdriver slot 160 that may be used to rotate the threaded member 150 for adjusting the force of the spring 152 from the tooling side. As shown in FIG. 6, in the present case, the tooling 86 is punch tooling having a stripper plate 162 shown in phantom lines. Four actuating pins 164, also shown in phantom lines, are arranged in slip fit holes in the tooling in axial alignment and abutting engagement with the four coupling ends 146. The force of the compression springs 152 is thereby transmitted to the stripper plate 162 via the cup-shaped members 144, the coupling ends 146, and the actuating pins 164. The junctions of the coupling ends 146 and the pins 164 are flush with the tool mounting surface 62 so that the tooling 86 can be easily removed from the tooling attachment plate 58 by removing the keys 88. However, before removing the tooling 86, the spring force on the actuating pins 164 must be removed. This is done with a release mechanism 180.

Figure 9:
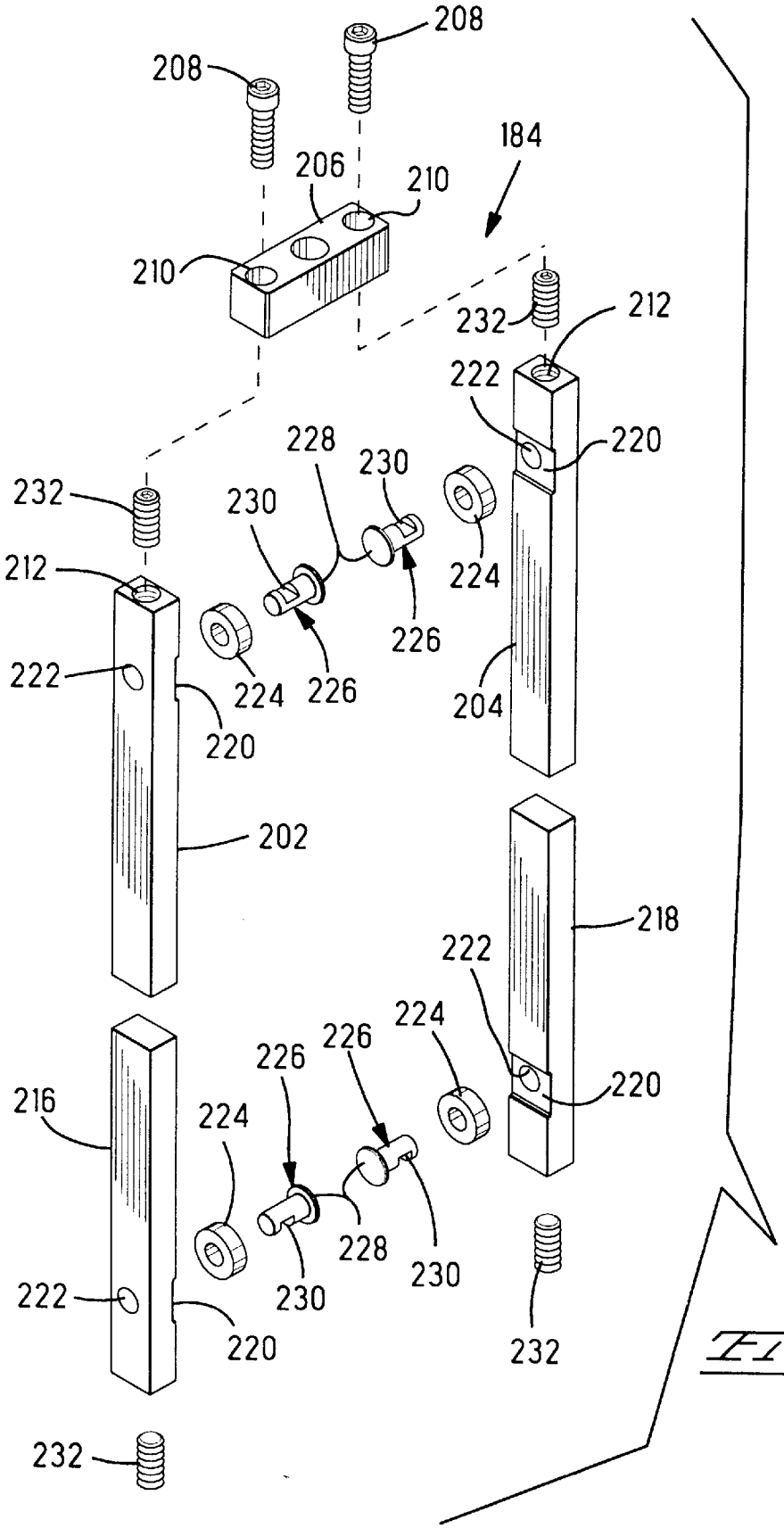
FIG. 9 is an exploded parts view of the mechanism shown in FIG. 8.

The release mechanism 180, as best seen in FIGS. 6 through 10, includes a cam 182 attached to each coupling end 146 and a follower frame 184 that engages the cam and compresses the spring 152. As best seen in FIG. 10, the cam 182 has a hole 182 that is a slip fit with the coupling end 146. An annular groove 188 is formed near one end of the coupling end and is aligned with a pair of diametrically opposed threaded holes 190 in the cam 192. Dog point set screws 192 are threaded into the holes 190 and into engagement with the groove 188 for securing the cam to the coupling end. The cam 182 is arranged in an opening 194 formed in the surface 122 of the tooling attachment plate 58. A pair of cam surfaces 196 are arranged, one on each side of the cam 182, so that the cam surfaces are facing upwardly, as viewed in FIG. 7. There are two follower frames 184 for each tooling attachment plate 58, each follower frame arranged to engage two cams 182, which are vertically aligned, as seen in FIG. 4. Each follower frame consists of left and right upper slide bars 202 and 204, respectively, interconnected by a tie bar 206. A pair of screws 208 extend through counterbored holes 210 in the tie bar and into threaded holes 212 in the slide bars 202 and 204, making the two slide bars and the tie bar a ridged unit. The two upper slide bars 202 and 204 are in sliding engagement with vertically disposed openings 214 formed in the tooling attachment plate 58. Left and right lower slide bars 216 and 218, respectively, are in sliding engagement with the openings 214 vertically under the left and right upper slide bars 202 and 204, respectively, and in abutting engagement therewith. Each of the four slide bars 202, 204, 216, and 218 has a shallow recess 220 formed in an inside facing surface, as best seen in FIGS. 8 and 9, and a hole 222 extending through the bar from the recess. A cam follower roller 224 is journaled for rotation on a pin 226 that extends into each of the four holes 222. Each of the pins 226 has an enlarged head 228 adjacent the cam follower and a notch 230 formed in the opposite end thereof extending into the hole 222. The left and right lower slide bars 216 and 218 each have a threaded hole formed in the end intersecting the hole 222. A dog point set screw 232 is in the threaded holes in engagement with the notch 230, thereby securing the pins 226 to their respective lower slide bars. Similarly, dog point set screws 232 are in the threaded holes 212 in the upper slide bars in engagement with the notches 230 of the upper slide bars, thereby securing the pins 226 to their respective upper slide bars. The left and right slide bars straddle the cams 182 so that each of the cam follower rollers 224 of the upper slide bars is in following engagement with a respective cam surface 196 of the upper cam 182 and each of the cam follower rollers 224 of the lower slide bars is in following engagement with a respective cam surface 196 of the lower cam 182. Each of the tooling attachment plates 58 includes a top bar 234 attached thereto by means of screws 236 that extend through holes in the top plate and into threaded holes in the tooling attachment plates. A thumbscrew 238 is arranged in a threaded hole in the top plate in vertical alignment with each follower frame 184, as shown in FIG. 4. The thumbscrew 238 is arranged to abut against the tie bar 206, as shown in FIGS. 7 and 8, so that by turning the thumbscrew one way or the other, the follower frame 184 is made to slide upwardly or downwardly in the openings 214. As the thumbscrew 238 is turned to move the follower frame downwardly, the follower rollers 224 cause the cams 182 and attached coupling ends 146 to move toward the right a small amount, as viewed in FIG. 7, thereby compressing the springs 152 and relieving the force on the actuating pins 164 so that the tooling 86 can be removed. When the thumbscrew 238 is turned in the opposite direction it begins to back away from the follower frame 184, but the forces from the springs 152 against the follower rollers 224 cause the follower frame to slide upwardly into abutting engagement with the thumbscrew.

The shut height adjusting mechanism 100 and the stripper plate actuating mechanism 140 are shown in only the first ram plate 50, but it will be understood that these mechanisms may also be incorporated in the second ram plate 52. Further, it will be understood that any combination of one or both of these mechanisms may be incorporated in either the first or second ram plates, or both ram plates. It is also contemplated that one or both of these mechanisms may be incorporated in the upper or lower ram plate of a conventional die set of the type that will be utilized in a conventional press. While the adjusting member 112 is shown in the form of a manually rotatable disc, it will be understood that the disc 112 may be replaced with a gear or sprocket driven by a control mechanism, not shown, that would permit automated adjustment of the shut height. Similarly, the thumbscrews 238 may be gear or sprocket driven by the control mechanism for releasing the stripper plate spring force for easy removal of the tooling 86, and the threaded members 150 may be driven for automated adjustment of the stripper plate spring force. All such variations and their equivalents are deemed to be within the spirit and scope of the present invention.

An important advantage of the present invention is that the mechanisms for effecting shut height adjustment and for actuating a tooling stripper plate are contained in the die set thereby obviating the need for duplicating these mechanisms in all of the individual tooling units that are ultimately to be used with the die set. This results in substantially less expensive and less complex individual tooling units.

I claim:

1. In a stamping and forming machine having a drive ram arranged to undergo reciprocating motion, a die set comprising:

(1) a first ram plate having coupled thereto at least one first tool plate with a first mounting surface for receiving and carrying first stamping and forming tooling, and an opening;

(2) means for holding second stamping and forming tooling matable with said first stamping and forming tooling, said first and second stamping and forming tooling having a feed path therebetween for passage of a strip of material to be operated upon thereby;

(3) a drive coupling arranged to couple said drive ram to said first ram plate so that said drive ram imparts said reciprocating movement thereto; and (4) an actuating mechanism attached to and carried by said first ram plate arranged for effecting one of:

adjusting the shut height of said first stamping and forming tooling and actuating a stripper plate thereof, said actuating mechanism is a first shut height adjusting mechanism coupled to said first ram plate to adjust the shut height of said first stamping and forming tooling, said first shut height adjusting mechanism comprises a threaded member in threaded engagement with a threaded bore in said first ram plate, said threaded member including an end that is coupled to said first tool plate so that when said treaded member is rotated said first tool plate is moved with respect to said first ram plate, said threaded bore intersecting said opening and including a first adjusting member disposed in said opening and rigidly attached to said threaded member and arranged so that when said first adjusting member is rotated said threaded member is correspondingly rotated within said threaded bore.

2. The machine according to claim 1 wherein said opening intersects an outer surface of said first ram plate and said first adjusting member is accessible from said outer surface.

3. The machine according to claim 2 wherein said end coupled to said first plate is cylindrically shaped having an annular groove formed therein for receiving a locking member coupled to and carried by said first tool plate.

4. The machine according to claim 1 wherein said first adjusting member is disc-shaped having a plurality of holes formed in its periphery for receiving an external adjusting tool to aid in said rotation of said first adjusting member.

5. In a stamping and forming machine having a drive ram arranged to undergo reciprocating motion, a die set comprising:

a first ram plate having coupled thereto at least one first tool plate with a first mounting surface for receiving and carrying first stamping and forming tooling;

means for holding second stamping and forming tooling matable with said first stamping and forming tooling, said first and second stamping and forming tooling having a feed path therebetween for passage of a strip of material to be operated upon thereby;

a drive coupling arranged to couple said drive ram to said first ram plate so that said drive ram imparts said reciprocating movement thereto; and an actuating mechanism attached to and carried by said first ram plate arranged for effecting one of: adjusting the shut height of said first stamping and forming tooling and actuating a stripper plate thereof; and said actuating mechanism is a stripper plate actuating mechanism adapted to actuate a stripper plate of said first stamping and forming tooling, said stripper plate actuating mechanism comprises a presser member in sliding engagement with said first ram plate and in coupled engagement with said stripper plate.

6. The machine according to claim 5 wherein said presser member includes a second coupling and extending through said first tool plate and intersecting said first mounting surface.

7. The machine according to claim 6 wherein said second coupling end is cylindrically shaped and arranged to slide axially in a slip fit hole in said first tool plate.

8. The machine according to claim 7 including a resilient member arranged to apply a force urging said second coupling end to slide within said hole so that said second coupling end is urged toward said feed path.

9. The machine according to claim 8 wherein said resilient member is a compression spring and said stripper plate actuating mechanism includes a second adjusting member coupled to said first ram plate and arranged to selectively compress said spring to increase said force against said presser member and to selectively expand said spring to decrease said force.

10. The machine according to claim 9 wherein said second adjusting member is threaded portion of said bore in said first ram plate and arranged coaxial with said second coupling end.

11. The machine according to claim 10 including a release mechanism coupled to and carried by said first tool plate and arranged to move said second coupling end in a direction away from said feed path against the urging of said spring.

12. The machine according to claim 11 wherein said release mechanism comprises:

(1) a cam attached to said second coupling end;

(2) a slide member in sliding engagement with an opening in said first tool plate;

(3) a follower attached to and carried by said slide member so that when said slide member is moved in one direction said follower tracks along a cam surface of said cam, thereby effecting said movement of said second coupling end against the urging of said spring.

13. The machine according to claim 12 wherein said release mechanism includes a third adjusting member in threaded engagement with a hole in said first tool plate and in abutting engagement with said slide member so that when said third adjusting member is rotated said slide member undergoes said movement.

14. The machine according to claim 12 wherein said release mechanism includes two spaced apart cam surfaces and two spaced apart slide members each having a respective follower attached thereto in following engagement with a respective on of said two cam surfaces.

15. The machine according to claim 5 wherein said stripper plate actuating mechanism comprises four spaced apart presser members in sliding engagement with said first ram plate and in coupled engagement with said stripper plate.

16. The machine according to claim 15 wherein said actuating mechanism includes a first shut height adjusting mechanism comprising a threaded member in threaded engagement with a threaded bore in said first ram plate including an end that is coupled to said first tool plate to adjust the shut height of said first stamping and forming tooling, and wherein said four presser members are spaced about said threaded member.

17. In a stamping and forming machine having a drive ram arranged to undergo reciprocating motion, a die set comprising:

a first ram plate having coupled thereto at least one first tool plate with a first mounting surface for receiving and carrying first stamping and forming tooling;

means for holding second stamping and forming tooling matable with said first stamping and forming tooling, said first and second stamping and forming tooling having a feed path therebetween for passage of a strip of material to be operated upon thereby;

a drive coupling arranged to couple said drive ram to said first ram plate so that said drive ram imparts said reciprocating movement thereto; and an actuating mechanism attached to and carried by said first ram plate arranged for effecting one of adjusting the shut height of said first stamping and forming tooling and actuating a stripper plate thereof, said actuating mechanism is a first shut height adjusting mechanism coupled to said first ram plate to adjust the shut height of said first stamping and forming tooling, said means for holding second stamping and forming tooling comprises a second ram plate having coupled thereto at least one second tool plate with a second mounting surface, opposed to said first mounting surface, for receiving and carrying second stamping and forming tooling matable with said first stamping and forming tooling, and wherein said actuating mechanism includes a second shut height adjusting mechanism coupled to said second tool plate to adjust the shut height of said second stamping and forming tooling.

18. In a stamping and forming machine having a drive ram arranged to undergo reciprocating motion, a die set comprising:

a first ram plate having coupled thereto at least one first tool plate with a first mounting surface for receiving and carrying first stamping and forming tooling;

means for holding second stamping and forming tooling matable with said first stamping and forming tooling, said first and second stamping and forming tooling having a feed path therebetween for passage of a strip of material to be operated upon thereby;

a drive coupling arranged to couple said drive ram to said first ram plate so that said drive ram imparts said reciprocating movement thereto; and an actuating mechanism attached to and carried by said first ram plate arranged for effecting one of: adjusting the shut height of said first stamping and forming tooling and actuating a stripper plate thereof; and said actuating mechanism is a stripper plate actuating mechanism adapted to actuate a stripper plate of said first stamping and forming tooling, said means for holding second stamping and forming tooling comprises a second ram plate having coupled thereto at least one second tool plate with a second mounting surface, opposed to said first mounting surface, for receiving and carrying second stamping and forming tooling matable with said first stamping and forming tooling, and wherein said actuating mechanism includes a second stripper plate actuating mechanism adapted to actuate a stripper plate of said second stamping and forming tooling.

* * * * *